US005635219A

United States Patent [19]

Schröfele et al.

[11] Patent Number: 5,635,219

[45] Date of Patent: Jun. 3, 1997

[54] SLIDE OPENING SYSTEM FOR A TOOL SYSTEM FOR COMPACTING POWDERY MATERIALS

[75] Inventors: Josef Schröfele, Penzberg; Roland Fleissner, Benediktbeuren, both of Germany

[73] Assignee: Dorst-Maschinen- und Anlagenbau Otto Dorst und Dipl.-Ing. Walter Schlegel GmbH & Co., Germany

[21] Appl. No.: 446,564

[22] Filed: May 19, 1995

[30] Foreign Application Priority Data

May 31, 1994 [DE] Germany ..... 44 19 083.2

[51] Int. Cl.[6] ..... B29C 43/00

[52] U.S. Cl. ..... 425/78; 425/406; 425/411; 425/DIG. 5

[58] Field of Search ..... 425/78, 150, 406, 425/411, 444, 451.4, DIG. 5

[56] References Cited

U.S. PATENT DOCUMENTS

| | | | |
|---|---|---|---|
| 3,132,378 | 5/1964 | Johannigman | 425/78 |
| 3,635,617 | 1/1972 | Hara et al. | 425/78 |
| 3,694,127 | 9/1972 | Takahashi et al. | 425/78 |
| 3,802,818 | 4/1974 | Watanabe et al. | 425/78 |
| 3,972,670 | 8/1976 | Henkel | 425/78 |
| 4,379,684 | 4/1983 | Katagiri et al. | 425/78 |
| 4,392,800 | 7/1983 | Apuzzo | 425/411 |
| 5,049,054 | 9/1991 | Schaidl et al. | 425/78 |

FOREIGN PATENT DOCUMENTS

AS 1502147 1/1963 Germany .

OTHER PUBLICATIONS

Strasser, F.: Transformations Possibiles Du Movement Normal Dùne Presse. Machine Moderne, Apr. 1959, pp. 38–40.

*Primary Examiner*—C. Scott Bushey
*Attorney, Agent, or Firm*—Reese Taylor

[57] ABSTRACT

A slide opening system for a tool system for compacting powdery materials having an upper ram, a lower ram and an insertable tool frame in which punch holders are moved relative to the base-plate from their filling position downward to the pressing position and from the pressing position upward to the ejection position which corresponds to the filling position (ejection method), and a further punch holder is moved from the filling position downward to the pressing position and from the pressing position downward to the withdrawal position (withdrawal method), with plungers acting on slides for releasing the withdrawal plate for the withdrawal motion, whereby the plungers of the slide opening system each act on a preferably stepped slide via a pivoted lever in the form of a cam disk with leverage that changes during the opening process and at least one roll located on the lever.

20 Claims, 3 Drawing Sheets

SLIDE OPENING SYSTEM FOR A TOOL SYSTEM FOR COMPACTING POWDERY MATERIALS

BACKGROUND OF THE INVENTION

1. Field of the Invention

This invention relates to a slide opening system for a tool system for compacting powdery materials, in particular a slide opening system for a press for producing compacts from powdery materials having an upper ram and lower ram and a multiplate system formed as an adapter unit which can be installed in and dismounted from the press in a tool frame. Specifically, the present invention relates to a slide opening system for a tool system wherein a lever arm is activated by plungers to translate a stepped slide.

2. Description of the Prior Art

Such a press with a multiplate adapter is known from German laid-open print DE-OS 39 09 757. In this press three punch holding plates are movable via hydraulic piston/cylinder units from a base-plate fixed relative to the press, two of which work by the ejection method, i.e. are moved from the filling position downward to the press end position and from the press end position upward to the ejection position.

For producing a broad diversity of stepped compacts in a great variety of forms the third punch holding plate works by the withdrawal method, whereby the punch holding plate or withdrawal plate is likewise movable via a hydraulic piston/cylinder unit.

The motion of the withdrawal plate from the pressing position in which the withdrawal plate rests on a fixed stop to the withdrawal position is coupled with the motion of the lower ram, since stops present on the die plate come to rest against the withdrawal plate. Simultaneously with the downward motion of the die holding plate slides are moved away laterally outward via corresponding stops so as to create thereunder a space for the downward motion of the withdrawal plate to the withdrawal position.

Since the die motion is to be executed as quickly as possible, an equally quick power transmission is necessary for the lateral moving away of the slides. The power transmission is provided by a wedge which is operated at its upper end by a stop disposed on the die plate. This wedge is beveled at an angle of 45° at its lower end and urges the slide outward via a roll with the slanting surface when moving down.

This gives rise to very great diverting forces in the slide opening mechanism and thus high stress on the roll. That leads to quick wear of the roll bearing, so that this construction can no longer be used as of a tonnage of approx. 150 t.

SUMMARY OF THE INVENTION

The problem of the invention is accordingly to prevent these disadvantages and provide a slide opening system for a tool system for compacting powdery materials which is also suitable for large occurring forces or tonnages.

This problem is solved according to the invention by providing a lever that, in response to translation of a plunger, functions to translate a stepped slide.

According to the invention one provides a slide opening system comprising a plurality of cooperating components, whereby a stop or spindle located on the die holding plate and adjustable relative thereto operates, during the withdrawal motion, a plunger having at its lower end a unilaterally slightly rounded contact surface via which the plunger in turn causes a lever to swivel.

The lever, whose leverage changes during the opening process, is pivoted in the punch holding or withdrawal plate and includes on one side a segment of a curve connected with the lever via which the lever urges the slide radially outward.

This motion takes place until the stop or rod rests on a plate and the plunger is no longer moved downward. At this time the slide overcomes a divided step, so that a tangential motion downward takes place simultaneously with the stopping of the radially outward motion.

This causes a roll located on the lever to reach a slope connected with the base-plate of the press, on which it rolls downward thereby causing the further radially outward opening motion of the slide via the cam disk.

The swivel of the lever and thus the slide opening motion is thus expediently executed in two steps. The first step takes place through the lowering of the plunger, while the second step is brought about by the rolling of the roll on the slope after the slide has overcome the divided step.

This construction of the slide opening system permits an improved power transmission by the plunger in comparison to the prior art, because at the beginning of the opening motion, when the greatest forces occur, there is area contact instead of line contact between plunger and lever and in particular also between the bearing shell and the shoulder of the lever.

Due to the form of the pivoted lever the leverage changes additionally during the opening process, so that the greatest force is applied at the beginning and the smallest toward the end of the opening motion. It is therefore readily possible to use a roll since only small forces act on the roll, in particular restoring forces of the slide caused by a spring.

The providing of a step divided into two supporting surfaces furthermore permits a high surface compression and a small opening path, which avoids a long withdrawal and permits the inventive slide opening system to be utilized with great tonnages.

BRIEF DESCRIPTION OF THE DRAWINGS

In the following these and other advantages of the present invention will be described with reference to a preferred embodiment with the aid of the enclosed drawings, in which.

DESCRIPTION OF THE PREFERRED EMBODIMENTS

Figure 1:
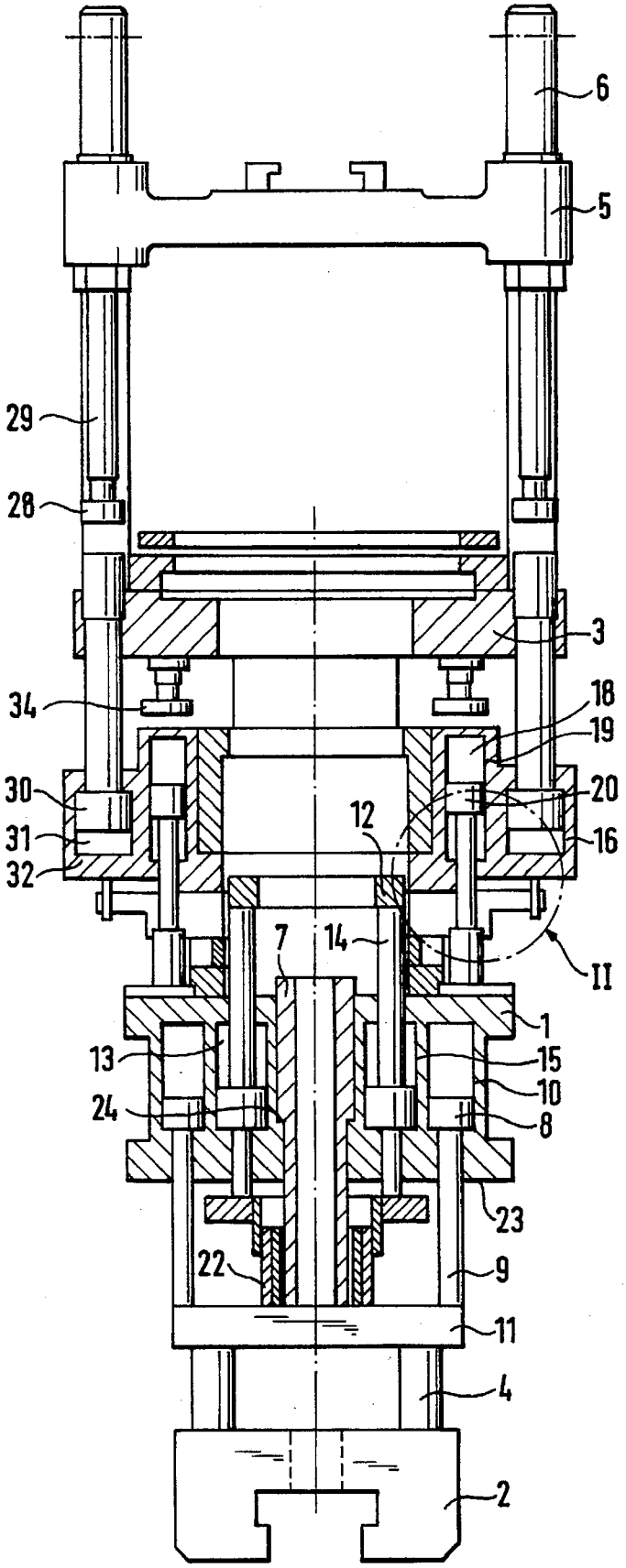
FIG. 1 shows a schematic view, in partial section, of a tool frame for a tool system for compacting powdery materials wherein the punch holding plates working by the ejection method are disposed below the withdrawal plate.

The tool frame shown in FIG. 1 includes a base-plate designated as 1 which is connected with the press in stationary and fixed fashion after installation of the tool frame. Guided displaceably in base-plate 1 is a framework which is constructed from lower coupling plate 2 and die holding plate 3 interconnected rigidly via tie rods 4. The displaceable guidance of the framework in base-plate 1 takes place via tie rods 4.

Lower coupling plate 2 is coupled or connected with the lower ram of the press. The connection of the tool frame to the upper ram of the press takes place via upper connection piece 5. Connection piece 5 is displaceable on guide rods 6 which are connected firmly with die holding plate 3.

Punch holder 7 is movable starting from base-plate 1. It works by the ejection method, i.e. is lowerable from the filling position to a pressing position and movable from the pressing position to an ejection position which corresponds to the filling position. The motion of punch holder 7 relative to base-plate 1 takes place via two piston/cylinder units 8 which are operated hydraulically. Pistons 9 of the piston/cylinder units are guided in cylinders 10 of base-plate 1 and act on plate 11 which is part of punch holder 7.

Further punch holder 12 is movable from base-plate 1 by two piston/cylinder units 13, the pistons designated as 14 being guided in cylinders 15 formed in base-plate 1. Punch holder 12, also referred to as a bridge, works like punch holder 7 by the ejection method. For reasons of simplification punch holders 7 and 12 will thus be designated as ejection plates in the following.

In contrast, third punch holder or punch holding plate 16 works by the withdrawal method, as does die holding plate 3, which is lifted by the lower ram of the press (not shown) to the filling position via tie rod 4 due to the coupling with lower coupling plate 2, moved downward in controlled fashion from the filling position during the pressing operation, and moved downward by the lower ram, after the upper punch is lifted off the compact, far enough for the compact to be released.

Punch holder 16, also designated as withdrawal plate 16 in the following, is displaceable relative to base-plate 1, whereby cylinders 18 of the two piston/cylinder units 19 are formed in withdrawal plate 16 itself. The lower ends of pistons 20 are connected to base-plate 1.

The filling position of punch holder 7 working by the ejection method is limited by nuts 22 which are disposed on plate 11 and come to rest against underside 23 of base-plate 1. Nuts 22 are adjustable relative to each other to guarantee a possibility of adjusting the stop. The pressing position of ejection plate 7 is defined by shoulder 24 resting against an inside bore of base-plate 1.

The filling position of ejection plate 12 is defined by an adjustable stop ring not shown in FIG. 1 which strikes underside 23 of base-plate 1 in the filling position.

The filling position of withdrawal plate 16 is defined by stops (not apparent from FIG. 1) on withdrawal plate 16, whereby a threaded rod screwable relative to base-plate 1 is provided for the purpose of adjustment, defining with a head as a stop shoulder the motion of withdrawal plate 16 and thus the filling position. In the pressing position withdrawal plate 16 is urged over the powder column and is also supported thereby relative to base-plate 1 via stop 39 shown in FIG. 2. Alternatively, withdrawal plate 16 can also be moved from its filling position to the pressing position by adjustable stops 28, which are fastened to upper connection piece 5 via rods 29, pressing on rods 30 connected with withdrawal plate 16 via pressure medium cushion 31.

Since the motion of withdrawal plate 16 from the filling position to the pressing position is coupled with the motion of upper connection piece 5 via the upper ram of the press, pressure medium from cylinder 32 can be let off for pressure medium cushion 31 via an outlet valve (not shown) when withdrawal plate 12 has already reached its pressing position before the upper ram reaches the pressing position. Otherwise the downward motion of the upper ram would be prevented by pressure medium cushion 31, which could lead to the destruction of press components.

Die holding plate 3 is moved to the filling position via the motion of the lower ram due to the coupling of the framework with lower coupling member 2. During the pressing operation die holding plate 3 is brought downward in controlled fashion, again due to the coupling with the lower ram via the framework, whereby die holding plate 3 is supported in the press end position in the press, namely via the lower ram.

Figure 2:
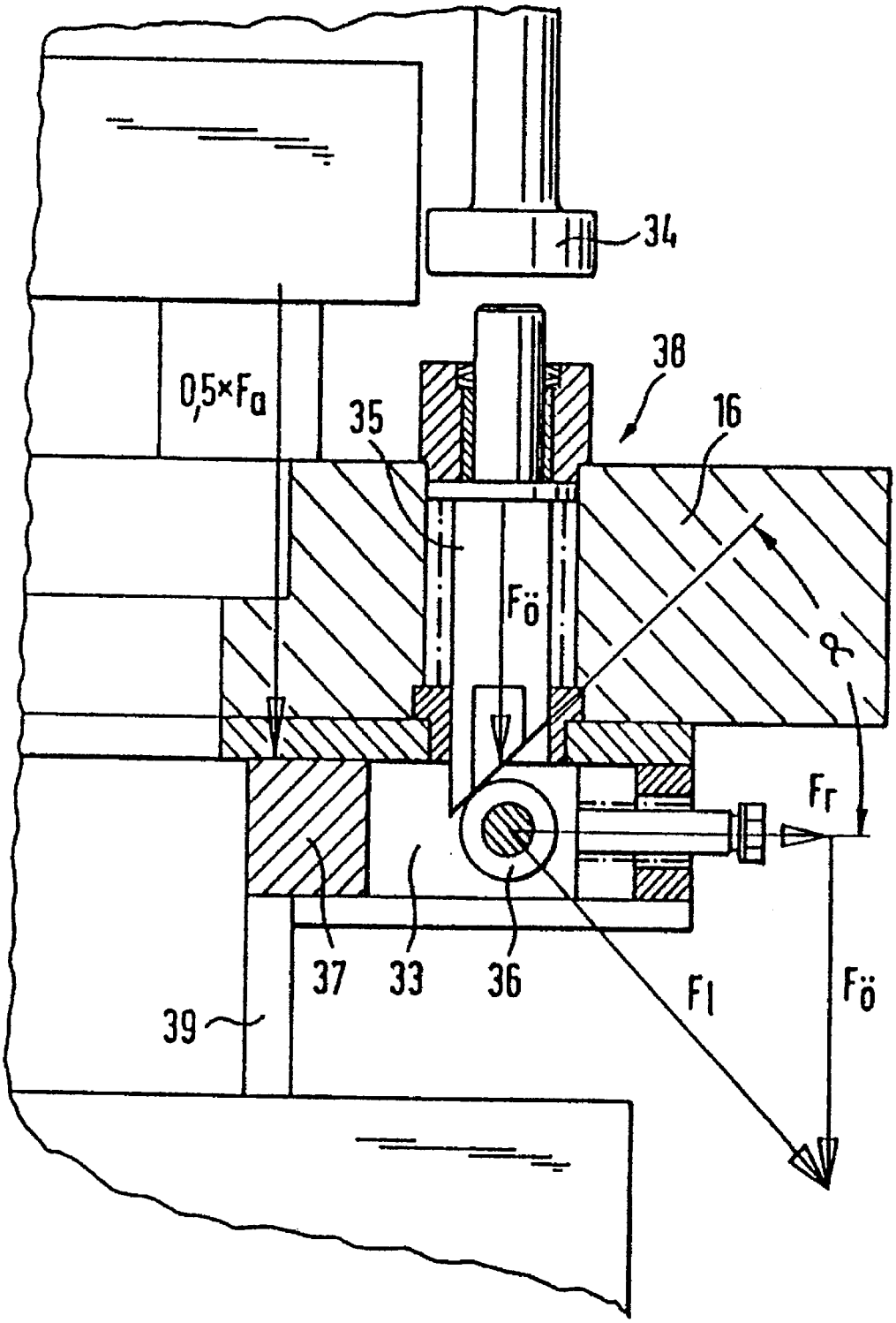
FIG. 2 PRIOR ART
FIG. 2 shows an enlarged, partly sectional schematic view of the portion marked by a dash-dot circle in FIG. 1, in which a prior art wedge system serves as the slide opening system.

In the prior art device, during the withdrawal motion of die holding plate 3 slides 33, here two slides 33, are moved away laterally outward, only right slide 33 being shown in FIG. 2. Left slide 33 is disposed mirror-symmetrically on the other side of the tool frame. This lateral motion away of slides 33 is obtained in the following way. When die holding plate 3 is transferred to the withdrawal position, adjustable stops 34 disposed on die holding plate 3 press on movable wedge 35 mounted in withdrawal plate 16 which urges, with its surface sloped at angle $\alpha$, slide 33 laterally outward via roll 36 so that the path downward is free for withdrawal plate 16, which is brought into the withdrawal position in conjunction with the downward motion of die holding plate 3. As soon as the path is free for withdrawal plate 16 by slides 33 being moved away, withdrawal plate 16 is brought into the withdrawal position via stops 34 with the further downward motion of die holding plate 3.

FIG. 2 further shows the relation of forces in slide opening system 38 functioning via wedge 35 and roll 36. $F_a$ designates the component of withdrawal force which acts on withdrawal plate 16 via the associated punch at the time when slides 33 begin to open. $F_{\ddot{o}}$ is the force necessary for opening slide 33 with which die holding plate 3 acts via stops 34 on wedge 35 and thus on roll 36 of slide 33. The frictional force which counteracts the opening motion is characterized as $F_r$, while $F_l$ is the force resulting from $F_r$ and $F_{\ddot{o}}$ which is taken up by roll 36.

Figure 3:
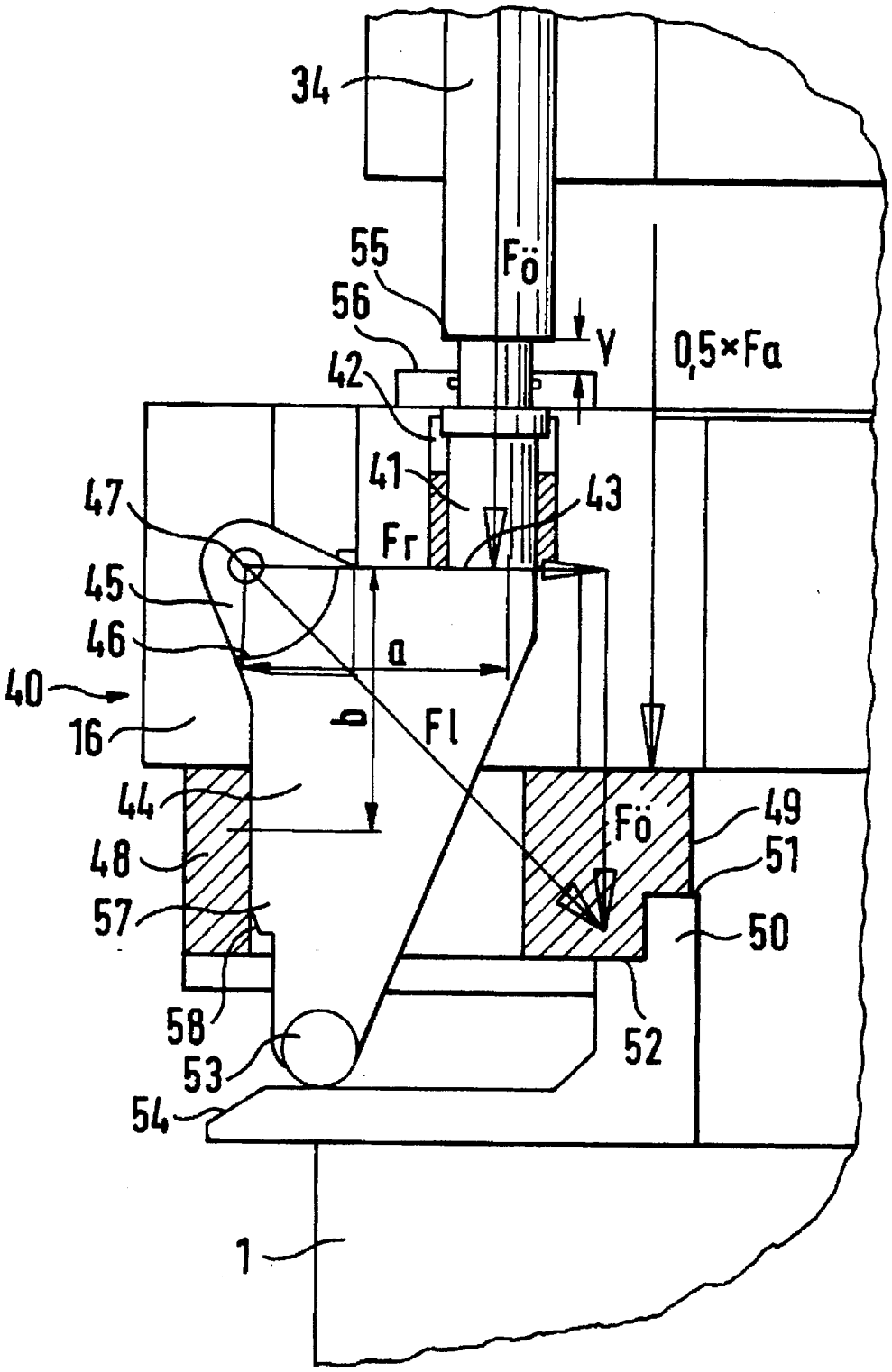
FIG. 3 shows a schematic and partly sectional view of an embodiment example of the inventive slide opening system.

An embodiment of inventive slide opening system 40 is shown in FIG. 3, whereby one can see only the part of slide opening system 40 on the left side of the tool frame. The other part of slide opening system 40 is constructed mirror-symmetrically and disposed on the right side of the tool frame.

In contrast to wedge system 38 from FIG. 2, when die holding plate 3 moves the die down to the withdrawal position it acts via adjustable stops or rods 34 not on wedges 35, but on plunger 41. Stops 34 can be adjusted relative to die holding plate 3 since they are formed e.g. as spindles 34.

Plunger 41 engages bore 42 in punch holding plate or withdrawal plate 16 and has, unlike wedge 35 from FIG. 2, no sloped wedge surface but almost even connection surface 43 with a small outwardly directed radius conceived for the following swivel motion. Via connection or contact surface 43 plunger 41 acts on pivoted lever 44 with shoulder 45 formed therein which lies against bearing shell 46 disposed or formed on withdrawal plate 16 and forming a pivot bearing with shoulder 45 of lever 44. Pivoted lever 44 is connected with punch holding plate or withdrawal plate 16 in center 47 of the rotation.

Between plunger 41, or between its lower contact surface 43, and the corresponding upper contact surface of lever 44 facing plunger 41, as well as between lever 44 and slide 48 there is thus no line contact but flat contact, in contrast to wedge system 38 (wedge 35/roll 36). There is in particular area contact between shoulder 45 of lever 44 described below and bearing shell 46 at the time when the swivel motion breaks out, i.e. when the highest forces occur.

The downward motion of plunger 41 causes lever 44 to swivel outward around center 47 and urge slide 48 outward via cam disk 57, which is connected here with lever 44 by means of a screw or the like, with a suitable arc at 58 for supporting the swivel motion.

This likewise moves inner surface 49 of slide 48 facing the tool frame radially outward over step 50, so that punch holding plate or withdrawal plate 16 can be moved further downward. During this first radial outward motion, i.e. while slide 48 moves radially outward over step surface 51 up to the edge of step 50, stop or rod 34 covers path y. After that, stop 34 lies with its shoulder 55 on plate 56 which is disposed on withdrawal plate 16, so that no further plunger motion is possible relative to withdrawal plate 16.

Upon further downward motion of withdrawal plate 16 slide 48 must be moved further outward. This motion now takes place no longer via plunger 41 but via roll 53 mounted in lever 44, which rolls under constraint over slope 54, slope 54 being connected for example with base-plate 1. Instead of roll 53 one can also provide in particular two rolls mounted in lever 44, namely in front of and behind lever 44.

FIG. 3 shows the relations of force or leverage in inventive slide opening system 40 with the help of arrows and the letters a and b. $F_a$ designates the component of withdrawal force which acts on slide 48 at the time when slide 48 begins to open. $F_{\ddot{o}}$ is the force necessary for opening slide 48 with which die holding plate 3 acts via stop or rod 34 on plunger 41 and thus on lever 44. Frictional force $F_r$, which counteracts the opening motion, and $F_{\ddot{o}}$ yield resulting force $F_l$ which acts in center 47 of the swivel motion and is transmitted via shoulder 45 of lever 44 to bearing shell 46.

During the swivel motion the leverage changes. While at the beginning of the motion lever arms a and b are about equally long, i.e. a=b, lever arm a initially decreases and thereafter slightly increase continuously while lever arm b increases. This means that toward the end of the swivel motion, when the forces acting on slide 48 lessen, the radially outward motion of slide 48 is guaranteed by increasing lever arm b.

In inventive slide opening system 40 it is possible to use roll 53 even at great tonnages, in comparison to the use of roll 36 in wedge system 38, because no forces act on roll 53 with the exception of the slide restoring forces, which occur via a spring (not shown) with the help of which slide 48 is moved inward again.

The supporting surface of step 50 in the embodiment example shown in FIG. 3 is divided into two surfaces, namely upper step surface 51 and lower step surface 52. Since opening path y available is very small in order to avoid a long withdrawal, it suffices to move slide 48 outward without step 50 only at small tonnages. In contrast, the inventive slide opening system can be utilized through step 50 also at great tonnages.

Due to the arrangement of step surfaces 51 and 52 only half the required path is needed by the die motion and thus via plunger 41 during opening of slide 48, namely the path of inner surface 49 of slide 48 from its starting position via upper step surface 51 up to the step edge. The remaining path is covered under constraint via roll 53 in conjunction with slope 54.

The size of step surfaces 51 and 52 is equal in the present embodiment example. When dimensioning upper step surface 51 one must make sure that slide 48 can move downward further relative to base-plate 1 when inner surface 49 of slide 48 has reached its end position on step 50 forced by the plunger motion via lever 44.

We claim:

1. A slide opening system for a press for compacting powdery materials, the press having an upper ram, a lower ram, a base plate, an insertable tool frame, a die holding plate and at least one punch holding withdrawal plate which, like the die holding plate, is moved from a filling position downward to a pressing position and from the pressing position downward to a withdrawal position, the press further having plungers acting on slides for activating the slide opening system to release the withdrawal plate for the withdrawal motion; the slide opening system comprising a stepped slide (48); and a lever (44); the lever disposed such that the plungers urge the lever to pivot and translate the slide.

2. The slide opening system according to claim 1, wherein each of the plungers (41) is operated via suitable stops (34) connected with the die holding plate (3); each of the stops (34) being adjustable relative to the die holding plate.

3. The slide opening system according to claim 1 wherein each of the plungers (41) has on its underside a contact surface (43) for area contact with a corresponding contact surface on the lever (44).

4. The slide opening system according to claim 3, wherein the contact surface (43) has on one side an outwardly directed radius configured to contact the lever during swivel motion of the lever.

5. The slide opening system according to claim 1, wherein the lever (44) is pivoted to the withdrawal plate (16).

6. The slide opening system according to claim 1, wherein the lever (44) has a shoulder (45) formed in the lever disposed against a bearing shell (46) formed in the withdrawal plate (16) to form a pivot bearing.

7. (Amended) The slide opening system according to claim 1, wherein the lever (44) includes a cam disk (57) which urges the slide (48) radially outward during the swivel motion of the lever (44).

8. The slide opening system according to claim 7, wherein the cam disk (57) has a largely even contact surface (58) for area contact with the corresponding contact surface of the slide (48).

9. The slide opening system according to claim 7, wherein the cam disk (57) is a separate component which is connected to the lever (44) by a screw connection.

10. The slide opening system according to claim 1, wherein the lever includes at least two lever arms, the length of the arms (a, b) of the lever (44) changes during the slide opening process.

11. The slide opening system according to claim 10, wherein the length of each lever arm changes during the slide opening process in such a way that, for optimal power transmission, the length of one lever arm (a) is greatest when the swivel motion breaks out, and the length of the other lever arm (b) is greatest at the end of the swivel motion.

12. The slide opening system according to claim 2, wherein the stop (34) has a shoulder (55); the swivel motion of the lever (44) and the radially outward motion of the slide (48) being caused by the lowering of the stop (34) until the shoulder 55 contacts a plate (56), the plate (56) being disposed on the withdrawal plate (16).

13. The slide opening system according to claim 12, wherein the further opening of the slide (48) is caused by a rolling motion after the shoulder (55) of the stop (34) contacts the plate (56).

14. The slide opening system of any according to claim 13, wherein the lever (44) includes at least one roll (53) connected to the lever (44) for executing the rolling motion.

15. The slide opening system according to claim 14, wherein the at least one roll (53) rolls on a slope (54) connected to the base-plate (1).

16. (Amended) The slide opening system according to claim 13, wherein the slide (48) has an inner surface (49) and the base plate (1) has a step (50) connected thereto; the inner surface (49) of the stepped slide (48) moves radially outward at least over the step (50) before the onset of the rolling motion.

17. The slide opening system according to claim 16, wherein the step (50) has upper and lower step surfaces (51, 52) which are the same size.

18. In a press for compacting powdery materials, the press including a base plate having a slope portion and a step portion, a die holder and a withdrawal plate movable with respect to the base plate, and plungers for activating a slide opening system, the improvement comprising a slide opening system including a stepped slide and a lever, the lever pivotally attached to the withdrawal plate such that the plungers urge the lever to pivot and engage the slide, translating the slide radially outward.

19. The improvement according to claim 18, further comprising a roll connected to the lever such that after the slide is translated over the step in the base plate, further translation of the slide is accomplished by rolling motion of the roll on the slope of the base plate.

20. A slide opening system for a press having plungers for activating the slide opening system, the slide opening system comprising a lever pivotally connected to the press and a stepped slide, the lever being urged by the plungers to pivot, thereby translating the slide radially outward.

* * * * *